US007216998B2

(12) United States Patent
Fujita

(10) Patent No.: US 7,216,998 B2
(45) Date of Patent: May 15, 2007

(54) CHEMILUMINESCENT DEVICE

(75) Inventor: Masahiko Fujita, Koga (JP)

(73) Assignee: Lumica Corporation, Fukuoka (JP)

( * ) Notice: Subject to any disclaimer, the term of this patent is extended or adjusted under 35 U.S.C. 154(b) by 0 days.

(21) Appl. No.: 10/305,391

(22) Filed: Nov. 27, 2002

(65) Prior Publication Data

US 2004/0252484 A1 Dec. 16, 2004

(51) Int. Cl.
*F21K 2/00* (2006.01)

(52) U.S. Cl. ..... 362/34

(58) Field of Classification Search ..... 362/34; 222/94; 43/17.6

See application file for complete search history.

(56) References Cited

U.S. PATENT DOCUMENTS 5,370,828 A * 12/1994 Ladyjensky ..... 252/700
5,390,086 A * 2/1995 Holland ..... 362/34
5,508,893 A * 4/1996 Nowak et al. ..... 362/34
6,021,595 A * 2/2000 Noel ..... 43/17.6

* cited by examiner

*Primary Examiner*—Sandra O'Shea
*Assistant Examiner*—James W Cranson, Jr.
(74) *Attorney, Agent, or Firm*—Westerman, Hattori, Daniels & Adrian, LLP.

(57) ABSTRACT

A first object is to prevent the leakage of chemiluminescent liquid during chemiluminescence. A second object is to provide enhanced shock resistance. A third object is to provide enhanced hydraulic-pressure resistance and a product at a low cost. A chemiluminescent device comprises a container, and a synthetic-resin ampoule contained in the flexible container. The ampoule has a surface formed with a groove extending along the circumferential direction thereof.

16 Claims, 8 Drawing Sheets

CHEMILUMINESCENT DEVICE

FIELD OF THE INVENTION

The present invention relates to a chemiluminescent device widely applicable to various products utilizing luminescence, such as fishing tools, illuminators, emergency lamps, fish lamps or toys. In particular, the present invention relates to a low-cost chemiluminescent device excellent in shock resistance and/or hydraulic-pressure resistance and capable of preventing the leakage of liquids during use.

BACKGROUND OF THE INVENTION

A conventional chemiluminescent device is constructed in such manner that one of two kinds of liquids is enclosed in a glass ampoule, and the other liquid is filled in a container on the outside of the glass ampoule. Before use, the container is bent to break the glass ampoule so that one liquid in the ampoule and the other liquid are mixed together to generate chemiluminescence.

The conventional chemiluminescent device has the following disadvantages due to the ampoule made of glass.

1. During the operation of breaking the glass ampoule, the resulting glass chips can cause damage such as a hole in the wall of the container. Further, the glass chip would stick out through the hole in the worst case. A thin-walled glass ampoule has been used to prevent such an accident from occurring. However, the thin-walled glass ampoule is subject to breakage due to shocks, such as an accidental drop impact, in the product distribution process. In either case, as long as glass is used as the material of the ampoule, such a problem cannot be cleared up.

2. In case of using the conventional chemiluminescent device as a fish lamp for fish catching, the container will be deformed by hydraulic pressure, and the flatly deformed wall of the container can be damaged by the glass chips with higher probability.

3. The microscopic chips of the broken ampoule act as a catalyst in chemiluminescent reaction likely to create an increased luminescent intensity. This action is unsuited to luminescent devices intended for long-term luminescence.

4. The unburnable glass to be included in the used chemiluminescent device is disadvantageous for disposal treatments.

SUMMARY OF THE INVENTION

The present invention is directed to solve the aforementioned problems of the conventional chemiluminescent device.

Figure 3:
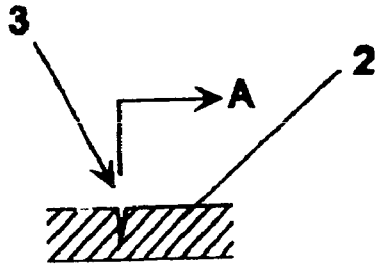
Figure 4:
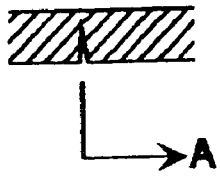
Figure 4:
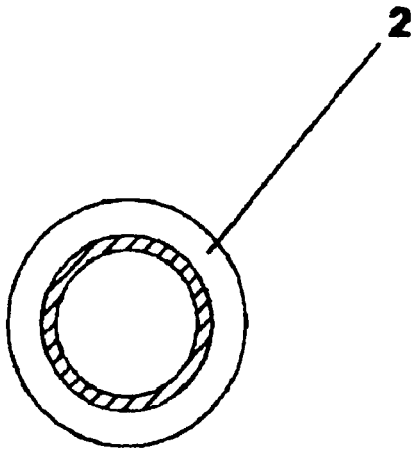
Figure 5:
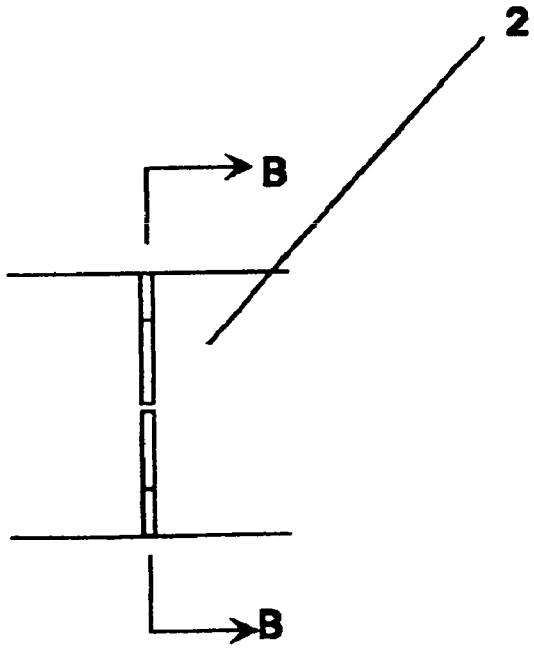
Figure 6:
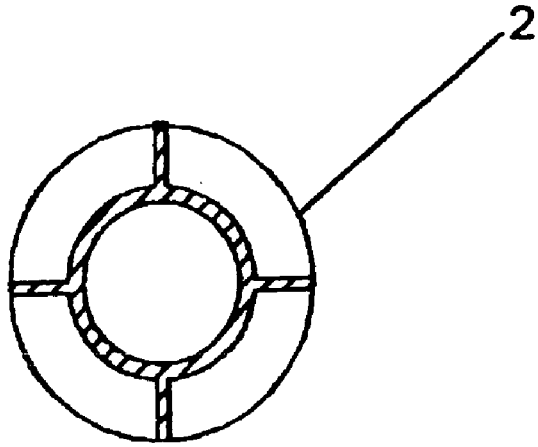
Figure 7:
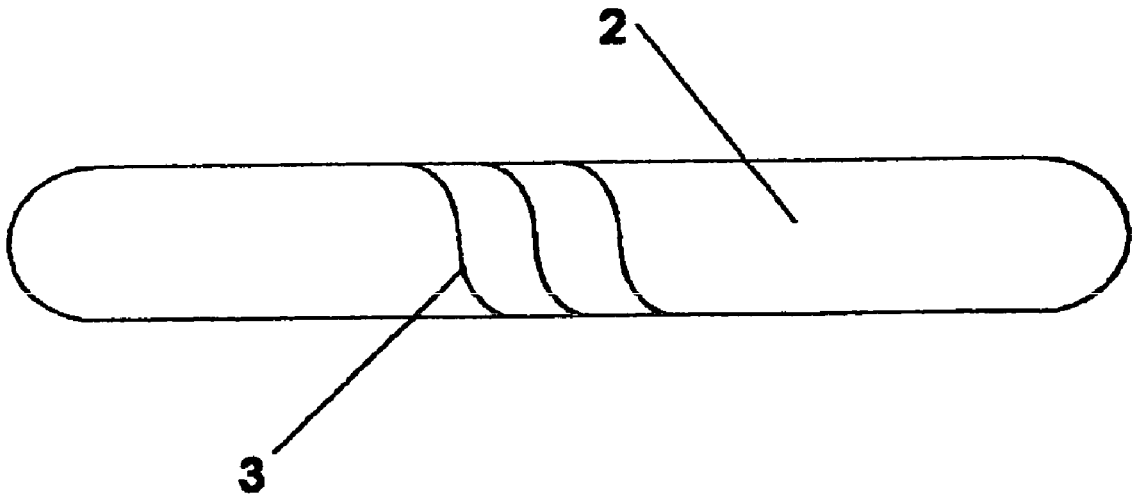
Figure 8:
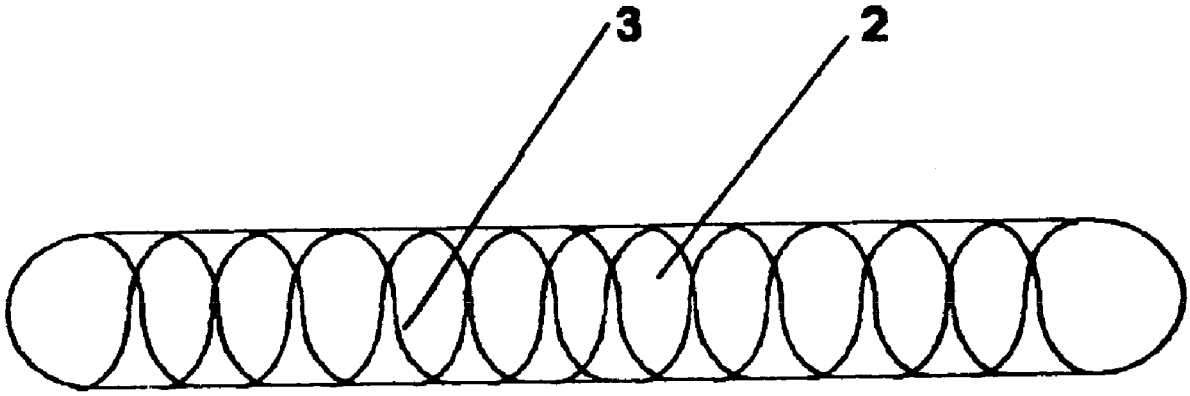

While the respective ends of a material to be formed as an approximately cylindrical synthetic-resin ampoule of the present invention are not limited to a specific shape, at least one of the ends is preferably provided with an opening having a small diameter to facilitate a process of fusedly closing or sealing the opening. The ampoule has a surface formed with a groove, such as a groove extending over the entire circumference of the ampoule as shown in FIGS. 3 and 4, a broken-line-shaped groove having non-grooved portions on the surface as shown in FIGS. 5 and 6, or a spiral groove as shown in FIGS. 7 and 8. It is to be understood that such a groove can be provided in a plural number or formed over the entire surface of the ampoule.

Before use of the chemiluminescent device, the ampoule is broken typically by bending the approximately longitudinal central region of the chemiluminescent device. Thus, it is desired to form the groove in the approximately longitudinal central region of the ampoule. While the groove may be formed in only one position, it is desired to provide a plural number of the grooves to assure a reliable breaking operation because the ampoule can be displaced within the container.

Figure 9:
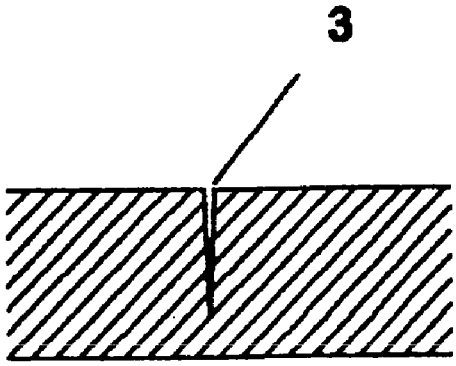
Figure 10:
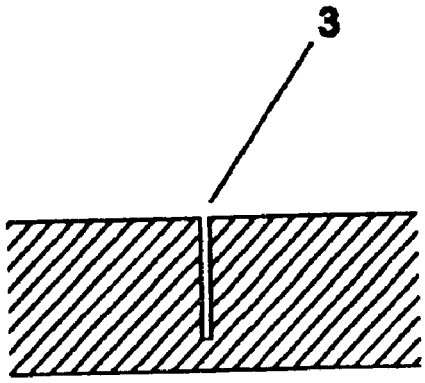

The groove provided in the ampoule may be formed in, but limited to, various shapes as shown in FIGS. 9 and 10. The depth of the groove may be appropriately designed depending on physical properties of selected synthetic resin of the ampoule, such as hardness, resiliency and tensile strength.

Generally, it is desired to select a harder grade in a certain synthetic resin as the martial of the ampoule. The two kinds of liquids can be sufficiently mixed together to generate chemiluminescence by dividing the ampoule at only one grooved portion. If the chemiluminescent device has a long length, it is necessary to divide the ampoule additionally at another grooved portion so as to allow the liquids to be smoothly mixed together.

When the ampoule having the broken-line-shaped or spiral groove formed on the surface thereof is bent and broken, the ampoule is not completely divided or separated into two pieces, and the broken ampoule still has a partially connected portion. After this operation, as the container is returned to its original position by its resilience, the bent ampoule is also returned approximately to its original position to reduce the open area of the broken portion. This allows the two kinds of liquids to be limitedly or gradually mixed together so as to maintain the chemiluminescent for a long time. Since no glass ampoule is used, the outer container can have a wall having a reduced thickness. The container used in the conventional chemiluminescent device has a wall thickness of 1.0 to 1.5 mm, whereas the wall thickness of the container of the present invention can be reduced down to 0.3 to 0.7 mm. The thin-walled container provides enhanced light transmittance. In addition, even if a hydraulic pressure acts on the chemiluminescent device, the thin-walled container can be adequately deformed to prevent occurrence of crack or fracture in the welded portion created during its molding process.

In particular, the present invention allows the chemiluminescent device to be applied to a fish lamp usable at deep ocean, for example, under the depth of 800 to 1000 mm. In the conventional chemiluminescent device, one of the liquids is enclosed in the glass ampoule by fusedly sealing the aforementioned opening with gas flame or the like. In this process, it is required to leaving a certain space between the opening and the level of the liquid to prevent burning of the liquid. This space will be added to the space of the container when the chemiluminescence is generated. In case of using the conventional chemiluminescent device at deep ocean, a certain hydraulic pressure acts on the entire container to compress the space and deform the container. For example, about 100 atm of hydraulic pressure acts at a water depth of 1000 mm. It is desired to minimize the space to prevent the deformation of the container due to such hydraulic pressure.

Resin has a melting temperature significantly lower than that of glass. Thus, the synthetic resin ampoule of the present invention can be formed by fusedly sealing the opening while leaving only a small space therein without any adverse affect on the liquid. For example, polypropylene or polyethylene having a melting temperature of 100 to 200° C. can eliminate the need for sealing the opening by using a gas flame of 800 to 1000° C. Thus, the chemiluminescent device of the present invention allows the space in the ampoule or the total space in the container to be minimized so as to suppress the deformation of the container and prevent any accident such as the breakage of the container.

The container and the ampoule of the present invention may be made of resin such as polyethylene, polypropylene, polyethylene terephthalate or nylon. However, the resin is not limited to such materials but any other suitable resin having chemical stability may be used.

The container or the ampoule of the present invention is not limited to a monolayered structure, but may be formed as a multilayered structure made of different materials. For example, a water-impermeable material such as vinylidene chloride may be used as an intermediate layer, or an aluminum thin layer may be used as an outer or inner layer. This structure can prevent mutual interference between the two kinds of liquids and adverse affects from the outside of the container to provide a product having a long-term stability.

While the following materials can be used as the chemiluminescent liquid of the present invention, they are simply shown as an example, and the composition of the chemiluminescent liquid is not limited to such materials.

One of the two kinds of liquids is an oxidizing liquid, and the other is a fluorescent liquid. The oxidizing liquid may be composed of dimethyl phthalate, t-butyl alcohol, hydrogen peroxide, and sodium salicylate serving as a catalytic agent. The fluorescent liquid may be composed of dibutyl phthalate, bis (2,4,5-trichloro-6-carbopentoxyphenyl) oxalate, and 1-chloro 9,10-bis (phenylethynyl) anthracene serving as a fluorescent material.

There have been known various other fluorescent materials such as 1,8-dichloro 9,10-bis (phenylethynyl) anthracene, 2-chloro 9,10-bis(4-phenylethynyl) anthracene, 1,6,7,12-tetraphenoxy-N,N'-bis(2,6-diisopropylphenyl)-3,4,9,10-perylene dicarboxyimide. Any color may be selected by combining two or more of the above fluorescent materials.

Figure 1:
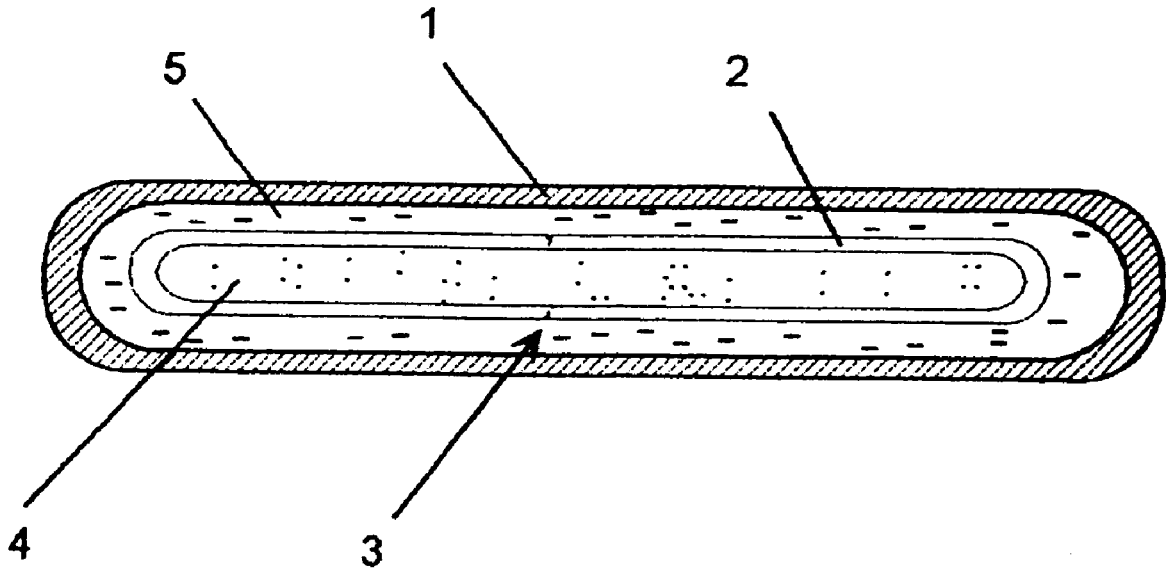

BRIEF DESCRIPTION OF THE DRAWINGS (FIG. 1) An explanatory sectional view of a first embodiment of the present invention.

Figure 2:
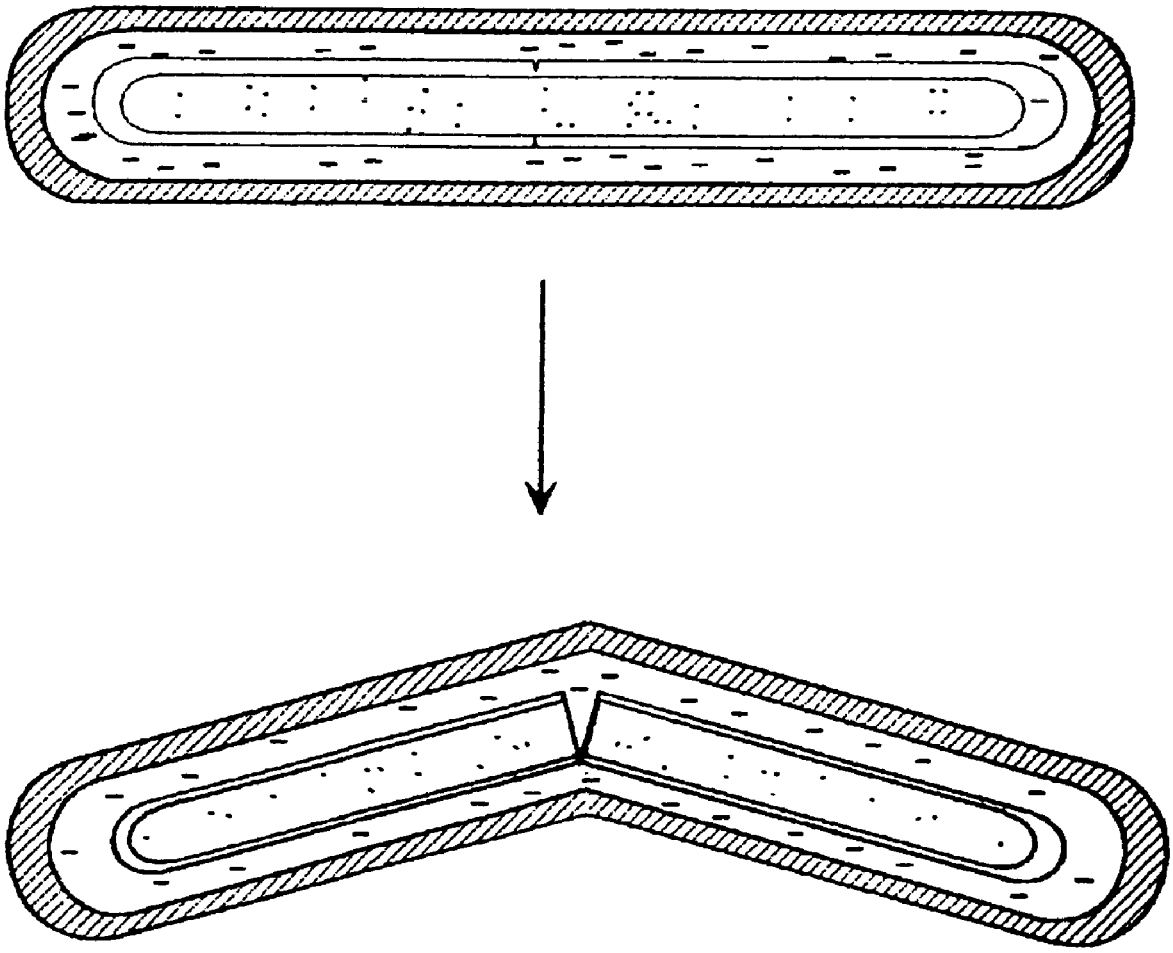

(FIG. 2) An explanatory view showing the state when the first embodiment is used.

(FIG. 3) An enlarged sectional view of a grooved portion of the first embodiment.

(FIG. 4) A sectional view taking along the line A—A in FIG. 3.

(FIG. 5) An enlarged view of a portion of an ampoule formed with a broken-line-shaped groove.

(FIG. 6) A sectional view taking along the line B—B in FIG. 5.

(FIG. 7) A view of a portion of an ampoule formed with a spiral groove.

(FIG. 8) A view of an ampoule formed with a cross spiral groove.

(FIG. 9) An enlarged sectional view of a V-shaped groove.

(FIG. 10) An enlarged sectional view of a U-shaped groove.

Figure 11:
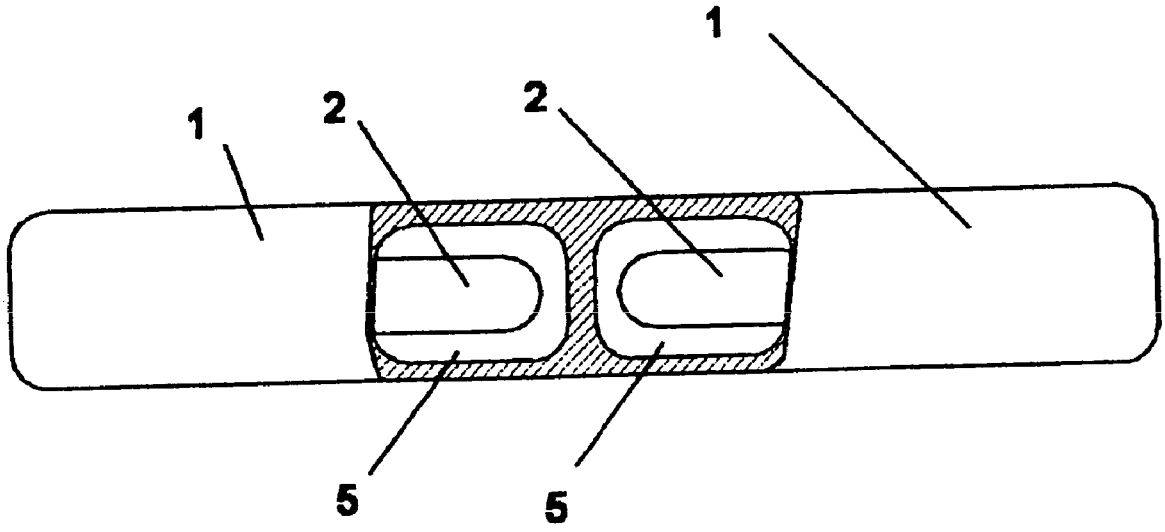

(FIG. 11) An explanatory sectioned view of a second embodiment.

Figure 12:
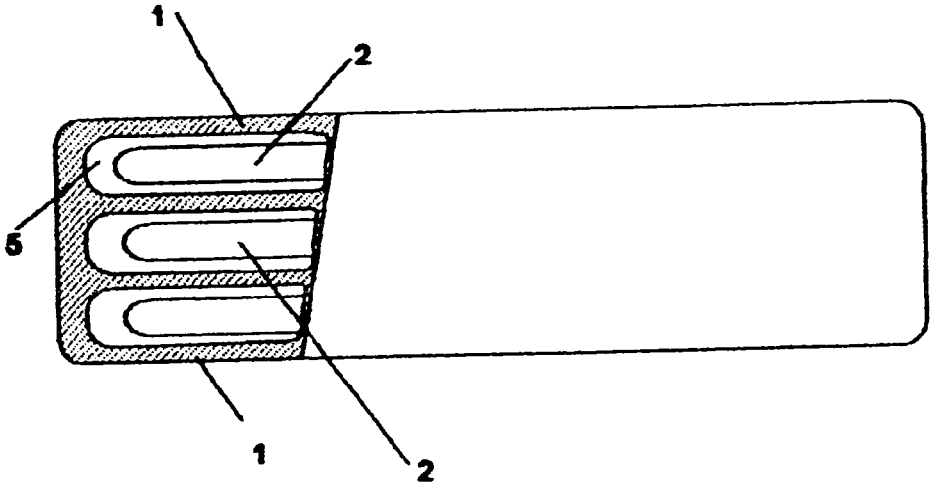

(FIG. 12) An explanatory sectioned view of a third embodiment.

Figure 13:
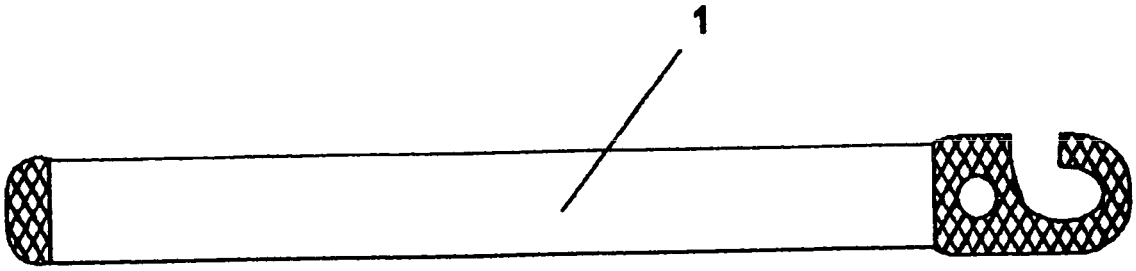

(FIG. 13) A view of a container having a hook with a hole attached thereto.

Figure 14:
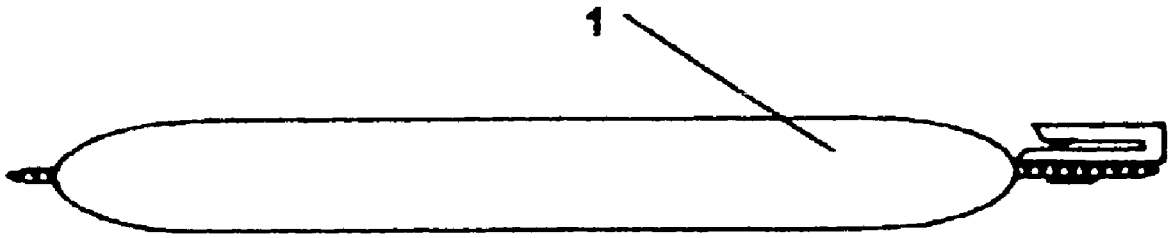

(FIG. 14) A view of a container having a hook attachment at one of the ends thereof.

REFERENCE NUMERALS

1: container; 2: ampoule; 3: groove; 4: oxidizing liquid; 5: fluorescent liquid

PREFERRED EMBODIMENT

The sectional shape of the approximately cylindrical ampoule of the present invention is not limited to a perfect circle, but may be ellipse or oval. Further, the container is not limited to a specific shape, but any other suitable shape capable of containing the ampoule may be used.

(First Embodiment)

On of the ends of a polyethylene pipe having an inner diameter Φ of 9.5 mm and an outer diameter of 10.5 mm is fusedly closed or sealed. A fluorescent liquid of 3.2 cc is charged into the container. Then, with a cutting tool, one groove having a depth of 0.5 mm is formed on the longitudinal central region of a polypropylene ampoule having an inner diameter Φ of 5.8 mm and an outer diameter of 7.5 mm, over its entire circumference.

After charging an oxidizing liquid of 1.6 cc into the ampoule, an opening of the ampoule is fusedly sealed. Then, the ampoule is inserted into the container, and the other end of the container is fusedly sealed.

Before use, when the container is bent while holding both ends of the container by hand, the ampoule contained in the container is simultaneously bent, and broken along the groove by tensile stress. Thus, the respective liquids in the ampoule and the container are mixed together to initiate chemiluminescence. While the ampoule is usually divided into two pieces by the above operation, the broken ampoule has a partially connected portion in some case.

In this case, the container can be bent in the opposite direction to divide the ampoule completely into two pieces.

(Second Embodiment)

This embodiment includes two of the above containers integrally combined in its longitudinal direction. In use, all of the containers may be operated to simultaneously generate chemiluminescence, or only one of the containers may be operated to generate chemiluminescence ahead of another container. Further, the luminescent color in each of the containers may be changed.

(Third Embodiment)

This embodiment includes three containers integrally combined in its lateral direction, and the ampoule is contained in each of the containers.

The present invention can provide a chemiluminescent device having the ampoule made of synthetic resin, capable of preventing the leakage of the chemiluminescent liquid from the container during use and the occurrence of defective products due to shocks in the product distribution process, with excellent hydraulic-pressure resistance at a low cost.

We claim:

1. A chemiluminescent assembly comprising a flexible container and a plural number of chemiluminescent devices, each of said chemiluminescent devices comprising:

an approximately cylindrical synthetic-resin ampoule movably contained in said flexible container, said ampoule having a surface formed with one or more grooves extending along the circumferential direction thereof; and two kinds of liquids capable of generating chemiluminescence when they are mixed together, one of said liquids being enclosed in said ampoule, the other liquid being enclosed in said container on the outside of said ampoule, wherein said chemiluminescent devices being integrally combined with each other.

2. The chemiluminescent assembly as defined in claim 1, wherein said groove is a broken-line-shaped groove formed on the surface of said ampoule to extend along the circumferential direction thereof.

3. The chemiluminescent assembly as defined in claim 1 or 2, wherein said groove is spirally formed on the surface of said ampoule.

4. The chemiluminescent assembly as defined in claim 1 or 2, wherein said groove has an approximately V-shaped section.

5. The chemiluminescent assembly as defined in claim 1 or 2, wherein said ampoule has a wall formed as a multilayered structure made of a plurality of different materials.

6. The chemiluminescent assembly as defined in claim 1 or 2, which includes a hole or hook provided at one end or both ends of said container.

7. The chemiluminescent assembly as defined in claim 1 or 2, which includes an attachment selected from the group of consisting of a hook and a hook with a hole, said attachment being fixedly attached to said container.

8. The chemiluminescent assembly as defined in claim 1, wherein the plural number of chemiluminescent devices are integrally combined in a lateral direction.

9. The chemiluminescent assembly as defined in claim 1, wherein the plural number of chemiluminescent devices are integrally combined in a longitudinal direction.

10. A chemiluminescent assembly comprising a flexible container and a plural number of chemiluminescent devices, each of said chemiluminescent devices comprising:

an approximately cylindrical synthetic-resin ampoule movably contained in said flexible container, said ampoule having a surface formed with one or more grooves extending along the circumferential direction thereof; and two kinds of liquids capable of generating chemiluminescence when they are mixed together, one of said liquids being enclosed in said ampoule, the other liquid being enclosed in said container on the outside of said ampoule, wherein said chemiluminescent devices being integrally combined with each other, and wherein the plural number of chemiluminescent devices are integrally combined in a lateral direction.

11. The chemiluminescent assembly as defined in claim 10, wherein said groove is a broken-line-shaped groove formed on the surface of said ampoule to extend along the circumferential direction thereof.

12. The chemiluminescent assembly as defined in claim 10 or 11, wherein said groove is spirally formed on the surface of said ampoule.

13. The chemiluminescent assembly as defined in claim 10 or 11, wherein said groove has an approximately V-shaped section.

14. The chemiluminescent assembly as defined in claim 10 or 11, wherein said ampoule has a wall formed as a multilayered structure made of a plurality of different materials.

15. The chemiluminescent assembly as defined in claim 10 or 11, which includes a hole or hook provided at one end or both ends of said container.

16. The chemiluminescent assembly as defined in claim 10 or 11, which includes an attachment selected from the group of consisting of a hook and a hook with a hole, said attachment being fixedly attached to said container.

* * * * *